US007664457B2

(12) United States Patent
Kim et al.

(10) Patent No.: US 7,664,457 B2
(45) Date of Patent: Feb. 16, 2010

(54) PRESET RECORDING METHOD THROUGH SERVICE LINKING IN DMB TERMINAL

(75) Inventors: Sun-Mi Kim, Seoul (KR); Young-Jip Kim, Suwon-si (KR); Byoung-Dai Lee, Seongnam-si (KR); Jin-Woo Jeon, Seongnam-si (KR); Kyung-Shin Lee, Seoul (KR)

(73) Assignee: Samsung Electronics Co., Ltd., Yeongtong-Gu, Suwon-Si, Gyeonggi-Do (KR)

( * ) Notice: Subject to any disclaimer, the term of this patent is extended or adjusted under 35 U.S.C. 154(b) by 654 days.

(21) Appl. No.: 11/541,854

(22) Filed: Oct. 2, 2006

(65) Prior Publication Data

US 2007/0087688 A1 Apr. 19, 2007

(30) Foreign Application Priority Data

Oct. 14, 2005 (KR) ..... 10-2005-0097229

(51) Int. Cl.
*H04H 7/00* (2006.01)

(52) U.S. Cl. ..... 455/3.06; 455/432.1; 455/456.1; 725/39; 725/50

(58) Field of Classification Search ..... 455/428, 455/414, 4.1, 3.02–3.06, 431, 432.1, 436, 455/456.1, 456.3, 566, 12.1, 503, 419, 420; 725/54, 58, 66, 39, 50; 370/252, 432, 328
See application file for complete search history.

(56) References Cited

U.S. PATENT DOCUMENTS

| | | | | |
|---|---|---|---|---|
| 2002/0038342 | A1 * | 3/2002 | Ito | 709/203 |
| 2005/0068977 | A1 * | 3/2005 | Na et al. | 370/432 |
| 2007/0002885 | A1 * | 1/2007 | Lee et al. | 370/432 |
| 2007/0017347 | A1 * | 1/2007 | Choi | 84/602 |
| 2008/0155608 | A1 * | 6/2008 | Han | 725/58 |
| 2008/0267583 | A1 * | 10/2008 | Komori et al. | 386/83 |
| 2009/0204996 | A1 * | 8/2009 | Kim et al. | 725/54 |

* cited by examiner

*Primary Examiner*—Sujatha Sharma
(74) *Attorney, Agent, or Firm*—Cha & Reiter, LLC

(57) ABSTRACT

A preset recording method through service linking according to movement from a first broadcasting area to a second broadcasting area in a terrestrial DMB terminal is provided. A preset recording for a predetermined broadcast program is checked to see if a current time is equal to a recording start time based on the specified preset recording; if so, extracting service linking information for the predetermined broadcast program; displaying that the DMB terminal has moved from the first broadcasting service area for the preset recording when the extracted service linking information corresponds to hard linking information, and recording a broadcasting program according to the hard linking information; and if they correspond, displaying that the DMB terminal has moved from the first broadcasting service area for the preset recording, and providing a list of broadcasting programs according to the soft linking information to enable a user to reset a preset recording function.

5 Claims, 4 Drawing Sheets

PRESET RECORDING METHOD THROUGH SERVICE LINKING IN DMB TERMINAL

CLAIM OF PRIORITY

This application claims the benefit under 35 U.S.C. 119(a) of an application entitled "Preset recording Method Through Service Linking In DMB terminal," filed in the Korean Intellectual Property Office on Oct. 14, 2005 and assigned Serial No. 2005-97229, the entire contents of which are incorporated herein by reference as if entirely set forth herein.

BACKGROUND OF THE INVENTION

1. Field of the Invention

The present invention relates to a digital multimedia broadcasting (DMB) service, and more particularly to a preset recording method using an electronic program guide (EPG).

2. Description of the Related Art

DMB, which is an abbreviation of "Digital Multimedia Broadcasting", is a service that provides various digital multimedia signals, such as voice and image, to a portable receiver or a receiver in a vehicle. Such DMB is classified into satellite DMB and terrestrial DMB, according to its transmission means. The satellite DMB provides program data to DMB terminals across a whole country by using a satellite radio, and the terrestrial DMB provides broadcasts by utilizing air-wave VHF channel Nos. 12 and 8.

Although the satellite DMB service and the terrestrial DMB service are individually provided at present, it is expected that both satellite DMB service and terrestrial DMB service will be provided through one combined DMB terminal in the future. In addition, such a combined DMB terminal is expected to perform even the general functions of a mobile communication terminal.

FIG. 1 is a block diagram illustrating a configuration for providing services to a DMB terminal.

A DMB terminal 100 is individually connected to a terrestrial DMB system 12, a satellite DMB system 13, and a mobile communication system 11 for supporting wireless data communication, such as a wireless broadband Internet (WiBro), so as to receive each service.

When receiving each DMB broadcast service from the terrestrial DMB system 12 and satellite DMB system 13, the DMB terminal 100 receives electronic program guides (EPGs) which are information about programs broadcasted by each broadcasting system.

Such EPGs are independently provided depending on each broadcast service.

Generally, the DMB terminal 100, which receives DMB broadcasts, includes a function of receiving and a function of outputting DMB broadcasts has and also includes a function of selecting and a function of recording a specific broadcast as requested by the user. There is an "instant recording" method for recording a broadcast by pressing a recording button while the user is receiving the broadcast, and a "preset (reserved) recording" method for recording a specific broadcast which is desired by the user and is received through a specific frequency at a preset time.

According to a procedure for setting up these recording functions, the instant recording is restricted to recording a broadcast which the user is currently viewing, and the preset recording requires selecting a separate menu and inputting information about a program to be recorded. Therefore, it is necessary to develop a method for setting up recording which can be easily applied by users.

In addition, according to the preset recording method, since provided DMB broadcasts differ according to country areas and the DMB terminal 100 is mobile, an ensemble of available broadcast programming may change due to movement of the terminal even though the terminal has been preset to record a specific broadcast received through a specific frequency at a preset time. Then, a different DMB broadcast may be recorded, instead of a specific DMB program preset by a user through a preset recording function of the DMB. An ensemble is a time, frequency and other identifying information regarding a specific broadcast programming and is FIG. 2 is a view illustrating a case in which a DMB terminal moves from one area to a different area, with the conventional preset recording function enabled.

In detail, FIG. 2 illustrates a case where a terrestrial DMB terminal 200-1 located in a first broadcasting area 21 moves to a second broadcasting area 22 (see reference numeral 200-2) in a state wherein a preset recording function has been specified for a specific broadcast program of KBS, a video service included in an ensemble 1 of the first broadcasting area 21.

For example, when the DMB terminal is preset to 9:00 AM in CITY A (i.e., first broadcasting area) to record a KBS program to be broadcast at 6:00 PM, and then the DMB terminal moves to CITY B (i.e., a second broadcasting area) at 5:00 PM, it becomes impossible to record the KBS program preset by the user because the DMB terminal cannot receive the preset program in CITY B.

Particularly, in the case of the terrestrial DMB, since the preset specification for a given broadcast can differ depending on broadcasting areas, there is a problem in that a preset recording may be performed which is contrary to the user's intention, when the broadcasting area in which a preset recording was specified differs from the broadcasting area in which the preset recording occurs. That is, there is a problem in that a broadcast different from that preset by the user may be recorded, or no broadcast is recorded at all.

Therefore, it is necessary to develop a function which modifies an already specified preset recording to reflect the broadcasting location of the DMB terminal when the DMB terminal moves from one terrestrial DMB broadcasting area to a different terrestrial DMB broadcasting area.

SUMMARY OF THE INVENTION

Accordingly, the present invention provides a preset recording method through service linking in a terrestrial DMB terminal, which enables the DMB terminal receiving a DMB broadcasting service to fulfill preset recording requests as completely as possible whenever the DMB moves from one broadcasting area to another.

Particularly, the present invention provides a method for directly performing a preset recording for a program by using electronic program guide (EPG) information to specify a preset.

In addition, the present invention provides a method for recording a program in relation to a specific program preset to be recorded in another broadcasting area, by using service linking information at the time of recording the specific program, when the DMB terminal has moved to a different broadcasting service area than that in which the specific program preset was specified.

In accordance with one aspect of the present invention, there is provided a preset recording method through service linking according to movement from a first broadcasting area to a second broadcasting area in a terrestrial DMB terminal, the method specifying a preset recording for a predetermined broadcast program in the terrestrial DMB terminal; checking if a current time is equal to a recording start time based on the specified preset recording; determining if the terrestrial DMB terminal has moved from the first broadcasting service area to the second broadcasting service are when the current time is determined to be equal to the recording start time; extracting service linking information for the predetermined broadcast program when it is determined that the terrestrial DMB terminal has moved from the first service area to the second broadcasting service area; displaying that the DMB terminal has moved from the first broadcasting service area for the preset recording when the extracted service linking information corresponds to hard linking information, and recording a broadcasting program according to the hard linking information; and displaying that the DMB terminal has moved from the first broadcasting service area for the preset recording when the extracted service linking information corresponds to soft linking information, and providing a list of broadcasting programs according to the soft linking information to enable a user to reset a preset recording function.

BRIEF DESCRIPTION OF THE DRAWINGS

The above and other features and advantages of the present invention will be more apparent from the following detailed description taken in conjunction with the accompanying drawings, in which.

DETAILED DESCRIPTION OF THE INVENTION

Hereinafter, preferred embodiments of the present invention are described with reference to the accompanying drawings. For the purposes of clarity and simplicity, a detailed description of known functions and configurations incorporated herein is omitted as it may obscure the subject matter of the present invention.

Figure 1:
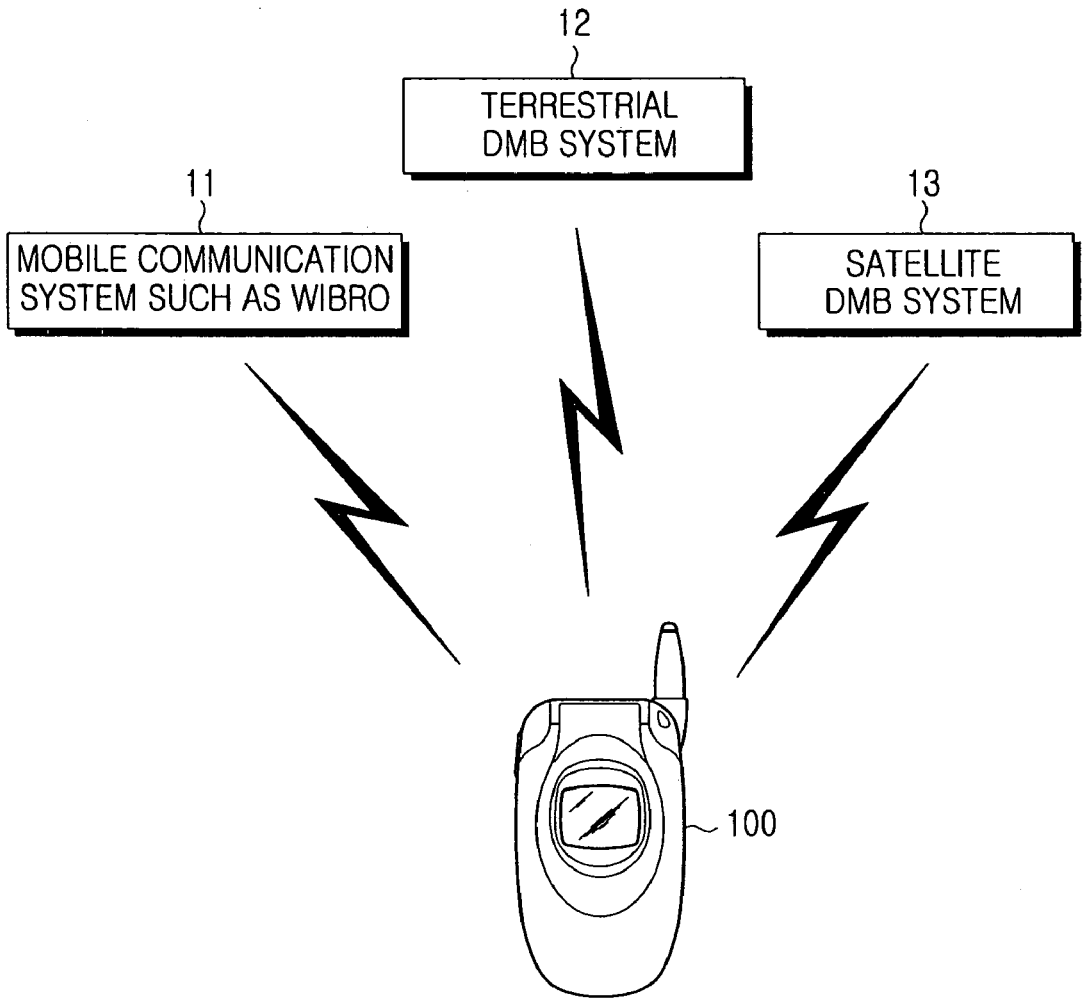
FIG. 1 is a block diagram illustrating a configuration for providing services to a DMB terminal.
Figure 2:
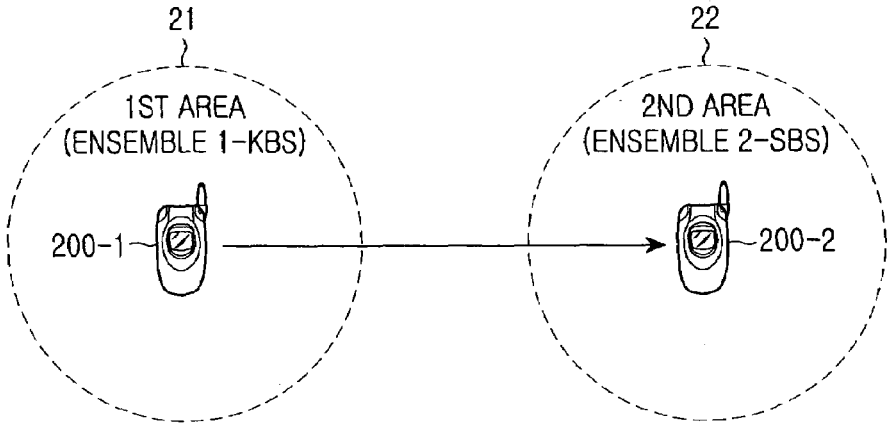
FIG. 2 is a view illustrating a case in which a DMB terminal moves from one broadcasting area to a different area, with the conventional preset recording function specified.
Figure 3:
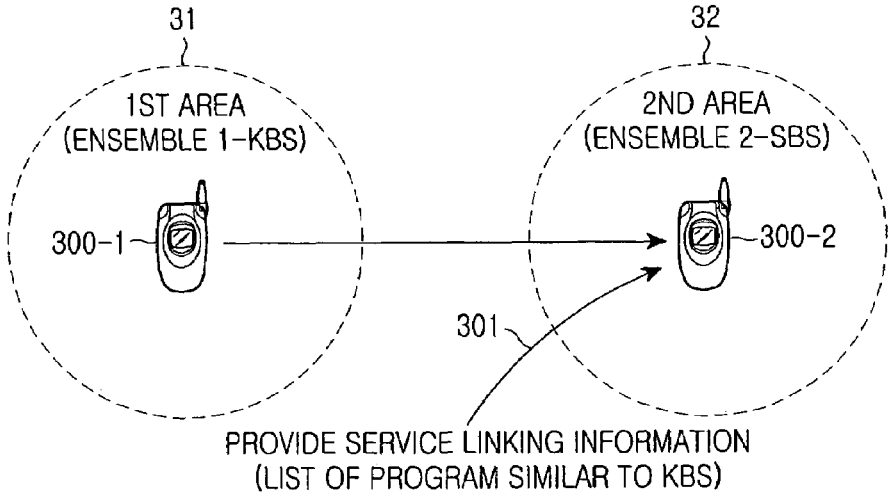
FIG. 3 is a view for explaining a procedure for a preset recording when a DMB terminal moves from one broadcasting service area to a different broadcasting service area, with a preset recording function specified, according to an embodiment of the present invention.

FIG. 3 is a view for explaining a procedure for a preset recording when a DMB terminal moves from one broadcasting service area to a different broadcasting service area, with a preset recording function specified, according to an embodiment of the present invention.

In detail, FIG. 3 illustrates a case where a terrestrial DMB terminal 300-1 located in a first broadcasting area 31 moves to a second broadcasting area 32 (see reference numeral 300-2) said terrestrial DMB terminal 300-1 having a preset recording function specified for a specific broadcast program of KBS, which is a video service included in ensemble 1 of the first broadcasting area 31.

For example, it is assumed that the DMB terminal is preset at 9:00 AM in CITY A (i.e., first broadcasting area) to record a KBS program to be broadcast at 6:00 PM, and then moves to CITY B (i.e., second broadcasting area) at 5:00 PM.

In this case, as described with reference to the prior art, since the constituents of an ensemble for the terrestrial DMB differs depending on broadcasting areas, a broadcast different from that preset by a user in advance may be recorded at a preset time, contrary to the user's intention, when a broadcasting area in which the preset recording is specified differs from a broadcasting area in which the preset recording starts. In order to avoid this situation, the present invention uses a service linking information 301 provided to a terrestrial DMB system.

Herein, the service linking information 301 is used to provide information about services in relation to each broadcasting service. According to the service linking information 301, relationships between services are classified into one of a soft link and a hard link, in which the hard link represents when a same broadcasting services are linked, and the soft link represents when a related broadcasting services are linked.

The service linking information 301 is included in and is transmitted with a multiplex configuration information (MCI) of a first information channel (FIC). In detail, the service linking information 301 is inserted into and transmitted with a frame in an extension of multiplex setup information in the MCI.

The transmitted frame includes a Program/Data (P/D) field, a Link Active (LA) field, a Soft/Hard (S/H) field, an ILS field, and IDlist field. Herein, the P/D field represents the format of a service identifier (ID), in which a value of "0" represents a program service, and a value of "1" represents a data service. The LA field represents whether or not a current link is active, and the S/H field represents whether a corresponding link is a hard link or a soft link. The ILS field represents whether or not a corresponding link has an influence in only one country (generally, this field is useful in the case of the European Union or the like). The IDlist field contains a list of services connected to a corresponding service. When it is represented through the LA field that a link is active, a list of services linked to a corresponding service (e.g., broadcast program) can be extracted from the IDlist, and one of the extracted services can be selected and connected to the terminal, in place of an original service which cannot be received due to movement of a DMB terminal having a preset that includes the original service.

That is, according to the present invention, if a DMB terminal moves from one broadcasting area to a different broadcasting area after having specified a preset recording, the DMB terminal notifies the user that the broadcasting service area has changed, instead of immediately starting a recording operation, when it becomes a preset time for the preset recording in said different broadcasting area. Then, the DMB terminal preferably automatically performs one of the actions selected from the group consisting of selects and starts a recording operation for a program in relation to a specific preset program which has been preset to be recorded by the user and displays programs similar to the specific preset program so that the user can newly select a program to be recorded.

The preset recording method through service linking according to movement between areas in the terrestrial DMB system is described with reference to FIG. 4.

Figure 4:
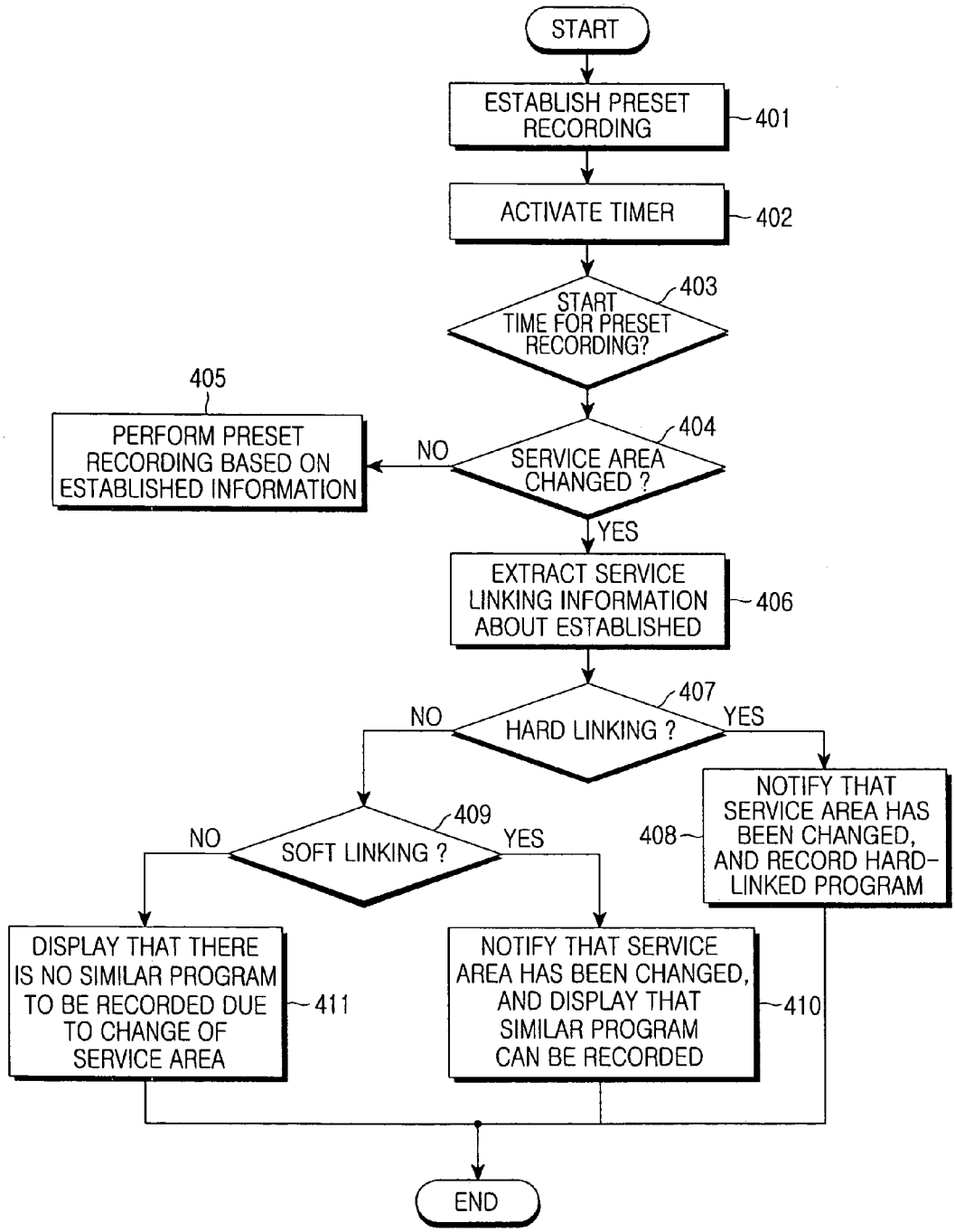
FIG. 4 is a flowchart illustrating the procedure for performing a preset recording method through service linking according to movement between areas in a terrestrial DMB system according to an embodiment of the present invention.

FIG. 4 is a flowchart illustrating the procedure for performing a preset recording method through service linking according to movement between broadcasting areas in a terrestrial DMB system according to an embodiment of the present invention.

According to the preset recording method through service linking according to movement between broadcasting areas in a terrestrial DMB system, first, when a preset recording is specified (step 401), a timer is activated (step 402) and then it is checked if the current time is equal tp a start time for the preset recording (step 403).

In step 403, when the current time equals the start time for the preset recording, it is determined if a broadcasting service area for the terminal in the terrestrial DMB system has been changed (step 404). When it is determined in step 404 that the broadcasting service area for the terminal has not been changed, the preset recording is performed according to conditions specified in the preset recording (step 405).

In contrast, when it is determined that the broadcasting service area for the terminal has changed, service linking information is extracted (step 406) about a broadcast program, which has been preset to be recorded in advance. Herein, the service linking information includes information about services in relation to each broadcasting service and has the information as described above.

Then, it is determined if the extracted service linking information corresponds to hard linking information (step 407).

When it is determined in step 407 that the extracted service linking information corresponds to hard linking information, it is displayed for the user that the broadcasting service area for the DMB terminal has been changed with respect to the preset recording, and a corresponding hard linked program is recorded (step 408). Since a program hard-linked to a specific program can be regarded as the same as the specific program, it is possible to record the hard linked program without any notification. In an alternative embodiment a list of hard-linked programs is displayed so that the user can select one program from the list.

In contrast, when it is determined in step 407 that the extracted service linking information does not correspond to a hard linking information, it is determined if the extracted service linking information corresponds to a soft linking information (step 409). When it is determined in step 409 that the extracted service linking information corresponds to a soft linking information, the user is notified on the display that the broadcasting service area for the DMB terminal has been changed with respect to the preset recording, the fact that a similar program can be recorded is displayed, and a list of similar programs is provided (step 410). Therefore, a similar program can be recorded according to a selection of the user from the displayed list of similar programs.

If there is no extracted service linking information (i.e., if both hard linking information and soft linking information have not been extracted), it is displayed for the user that a program preset to be recorded by the user cannot be recorded due to change of a broadcasting service area (step 411). That is, it is displayed that there is no similar program to be recorded in the broadcasting service area wherein the DMB terminal is located.

As described above, in a method for preset recording through service linking in consideration of movement between broadcasting areas in a terrestrial DMB system according to an embodiment of the present invention, when a terrestrial DMB terminal having a preset recording function is to record a specific program based on a condition specified in advance by a user, a different program may be recorded instead of the specific program preset to be recorded on the occurrence of a preset condition due to movement of the DMB terminal between broadcasting service areas. Therefore, the method of the invention provides service linking information which includes information about whether there is a program similar to the specific program in a broadcasting service area into which the terminal has newly moved, so that the user can reset or cancel the recording.

In this case, the service linking information about a channel of a preset recording program can be obtained either by storing the service linking information in a corresponding DMB terminal upon the specification of the preset recording, or by receiving service linking information about all channels from a communication network (e.g., CDMA network) of the corresponding DMB terminal.

Figure 5:
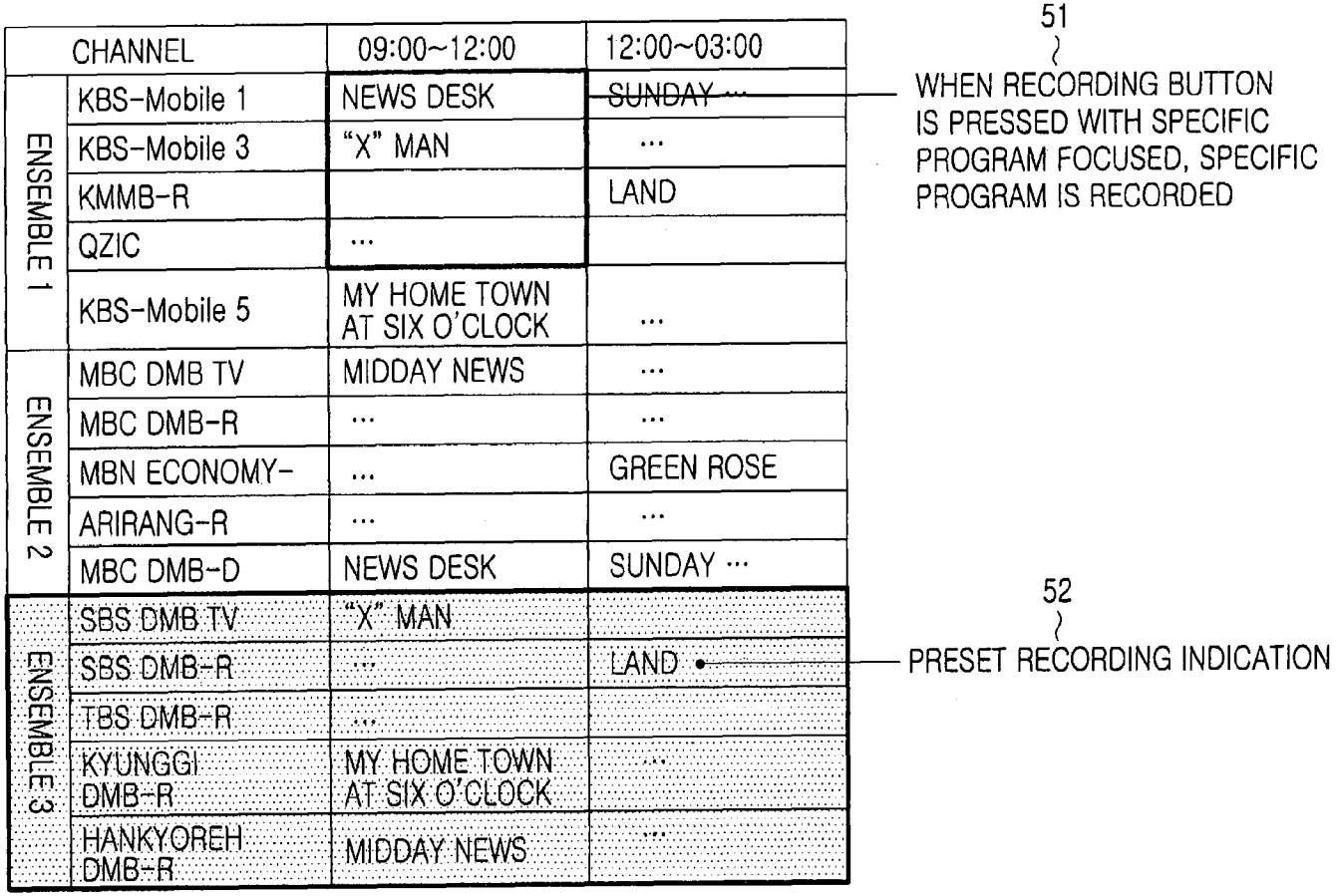
FIG. 5 is a view for explaining a preset recording specification method using EPG information in a terrestrial DMB system according to an embodiment of the present invention.

FIG. 5 is a view for explaining a preset recording specification method using EPG information in a terrestrial DMB system, according to an embodiment of the present invention.

Referring to FIG. 5, it can be understood that the preset recording specification method using EPG information in a terrestrial DMB system is achieved through EPG service.

First, when a terrestrial DMB terminal executes the EPG service, the DMB terminal can receive program information according to the EPG service. The program information received as above includes ensemble information, time information, and program titles, as shown in FIG. 5.

The user can see detailed information of a corresponding program through an upper information display window, while moving a focus (e.g., a highlight/cursor to indicate a program selected by the user) of a user interface of the EPG service on the received program information, see component 51 for an example focus.

According to the preset recording specification method using the EPG information based on an embodiment of the present invention, when the user selects a specific focused program on a program information screen based on the EPG service and presses a recording button, a preset recording for the specific focused program is specified 51.

When a preset recording has been specified as described above, it is displayed on the program information screen 52.

In addition, a program preset to be recorded may be canceled or changed in the same manner as that of the preset recording specification method.

That is, when the user selects a specific program and presses the recording button, any preset recording for the specific broadcast program that has been specified, the specific broadcast program is canceled. Also, if the preset recording for a second broadcast program, which will be broadcast at the same time as that of a first broadcast program preset to be recorded in advance, is specified, the preset recording for the first broadcasting program is canceled, and the preset recording for the second broadcasting program replaces the canceled preset.

Particularly, according to the present invention, when a preset recording for a broadcast program is specified on a program information screen using the EPG service, time information about a start time and an end time of the specified broadcast program and broadcasting frequency information thereof are automatically acquired through the EPG service. Therefore, it is possible to record a DMB broadcast input through a specific broadcasting frequency at a specific time based on the acquired information.

The method according to the present invention can be realized by a computer program and can be stored in a recording medium (such as a CD ROM, a RAM, a floppy disk, a hard disk, a magneto-optical disk, etc.) in a format that can be read and executed by a computer.

According to the present invention as described above, it is possible both to check program information and to specify/cancel a preset recording for a program by using the EPG service in the terrestrial DMB system, so that the user can easily adjust and use the recording function.

In addition, according to the present invention, although the terrestrial DMB terminal moves to a different broadcast service area out of a previous broadcast service area, the preset recording specified for a broadcast program in the previous broadcasting service area is not canceled, and information about broadcast programs identical to and/or similar to the preset broadcast program is provided to the user. Accordingly, the user can selectively replace a broadcast program to be recorded, so that it is possible to compatibly achieve both the preset recording function and the mobility of the DMB terminal.

While the present invention has been shown and described with reference to certain preferred embodiments thereof, it will be understood by those skilled in the art that various changes in form and details may be made therein without departing from the spirit and scope of the invention as defined by the appended claims. Accordingly, the scope of the invention is not to be limited by the above embodiments but by the claims and the equivalents thereof.

What is claimed is:

1. A preset recording method through service linking according to movement from a first broadcasting service area to a second broadcasting service area of a terrestrial DMB terminal, the method comprising the steps of:

specifying a preset recording including a recording start time and the first broadcasting area for a predetermined broadcast program in the terrestrial DMB terminal;

determining if a current time is equal to the specified recording start time;

determining if the terrestrial DMB terminal has moved from the first broadcasting service area to the second broadcasting service area when the current time is determined to be equal to the specified recording start time;

extracting service linking information for the predetermined broadcast program when it is determined that the terrestrial DMB terminal has moved from the first broadcasting service area to the second broadcasting service area;

when the extracted service linking information corresponds to hard linking information, performing the steps of:

a. displaying that the first broadcasting service area for the specified preset recording has changed, and b. recording a broadcasting program according to the hard linking information; and when the extracted service linking information corresponds to soft linking information, performing the steps of:

c. displaying that the service area for the preset recording has been changed, and d. displaying a list of broadcasting programs according to the soft linking information to enable a user to reset the specified preset recording function.

2. The method as claimed in claim 1, further comprising a step of performing the preset recording based on a condition of the specified preset recording in step when it is determined in that the terrestrial DMB terminal has not moved from the first broadcasting service area to the second broadcasting service area.

3. The method as claimed in claim 1, further comprising the steps of:

determining whether there is no extracted service linking information; and when it is determine that there is no extracted service linking information, displaying that a first broadcasting service area for the preset has been changed and that the predetermined broadcast program specified to be recorded through the preset cannot be recorded.

4. The method as claimed in claim 1, wherein the specifying step further comprises the step of storing the service linking information for the specified preset in the terrestrial DMB terminal.

5. The method as claimed in claim 1, wherein the extracting step further comprises the step of first receiving by the terrestrial DMB terminal from a mobile communication network, said service linking information including information about all broadcast programs.

* * * * *